US007662280B1

(12) United States Patent
Cooney

(10) Patent No.: US 7,662,280 B1
(45) Date of Patent: Feb. 16, 2010

(54) CATCH BASIN SEALING SYSTEM

(76) Inventor: John R. Cooney, 15 Beach La., North Haven, CT (US) 06473

( * ) Notice: Subject to any disclaimer, the term of this patent is extended or adjusted under 35 U.S.C. 154(b) by 710 days.

(21) Appl. No.: 11/467,805

(22) Filed: Aug. 28, 2006

(51) Int. Cl.
*E03F 5/06* (2006.01)

(52) U.S. Cl. ..... 210/164; 210/85; 210/739; 210/143; 404/25; 404/84.05; 251/326

(58) Field of Classification Search ..... None
See application file for complete search history.

(56) References Cited

U.S. PATENT DOCUMENTS

| | | | | | |
|---|---|---|---|---|---|
| 414,240 | A | * | 11/1889 | Norton | 114/183 R |
| 724,635 | A | * | 4/1903 | Weller | 70/423 |
| 736,714 | A | * | 8/1903 | Gendron | 16/401 |
| 742,075 | A | * | 10/1903 | Shade | 404/25 |
| 817,748 | A | * | 4/1906 | Boulden | 16/352 |
| 1,024,059 | A | * | 4/1912 | Brintnall | 49/33 |
| 1,329,405 | A | * | 2/1920 | Hinton | 210/163 |
| 2,056,362 | A | * | 10/1936 | Moore | 404/25 |
| 2,064,538 | A | * | 12/1936 | Hagan | 220/484 |
| 2,765,752 | A | * | 10/1956 | Imming | 104/52 |
| 3,087,178 | A | * | 4/1963 | Loomis | 14/71.3 |
| 3,241,673 | A | * | 3/1966 | Beresinsky | 209/395 |
| D244,854 | S | | 6/1977 | Salamone | |
| 4,120,919 | A | * | 10/1978 | McClain | 261/114.5 |
| 4,266,380 | A | * | 5/1981 | Samolis | 52/19 |
| 4,567,697 | A | * | 2/1986 | Hahne | 52/19 |
| 5,090,713 | A | * | 2/1992 | Johnson | 277/648 |
| 5,345,741 | A | | 9/1994 | Slater et al. | |
| 5,511,898 | A | * | 4/1996 | Pettesch et al. | 404/25 |
| 5,582,720 | A | * | 12/1996 | Deming | 210/164 |
| 5,702,595 | A | | 12/1997 | Mossburg, Jr. | |
| 5,732,512 | A | * | 3/1998 | Ueno et al. | 52/19 |
| 5,743,673 | A | * | 4/1998 | Bravo | 404/25 |
| 6,017,166 | A | | 1/2000 | Mossburg, Jr. | |
| 6,226,928 | B1 | | 5/2001 | Trangsrud | |
| 6,530,722 | B1 | * | 3/2003 | Shaw et al. | 405/52 |
| 6,558,077 | B1 | * | 5/2003 | Colson | 405/36 |
| 6,613,228 | B2 | | 9/2003 | Petersen et al. | |
| 6,719,489 | B1 | * | 4/2004 | Colson | 405/36 |
| 6,743,354 | B1 | * | 6/2004 | Evans et al. | 210/164 |
| 7,347,070 | B1 | * | 3/2008 | Spector | 70/169 |
| 7,404,690 | B2 | * | 7/2008 | Lukasik et al. | 404/36 |
| 7,455,474 | B2 | * | 11/2008 | Tievant et al. | 404/25 |
| 2003/0053862 | A1 | * | 3/2003 | Shaw et al. | 405/40 |
| 2005/0051467 | A1 | | 3/2005 | Yehuda | |
| 2007/0237580 | A1 | * | 10/2007 | Sulak et al. | 404/25 |
| 2008/0006568 | A1 | * | 1/2008 | Moody et al. | 210/164 |
| 2008/0145150 | A1 | * | 6/2008 | Shaw et al. | 405/52 |
| 2008/0149544 | A1 | * | 6/2008 | Shaw et al. | 210/163 |

* cited by examiner

*Primary Examiner*—Robert James Popovics

(57) ABSTRACT

A catch basin sealing system for closing a basin opening in a catch basin to inhibit contaminants from entering the catch basin includes a plurality of guide channels. Each of the guide channels is coupled to a bottom surface of a catch basin. The guide channels are positioned on opposing sides of a basin opening. A closing plate slidably engages the guide channels. The closing plate is slid from a first position adjacent the basin opening to a second position under the basin opening to close the basin opening and inhibit flow of liquid into the catch basin. A seal is coupled to an upper surface of the closing plate. The seal engages the catch basin around the basin opening to inhibit liquid flowing between the closing plate and the catch basin when the closing plate is positioned in the second position.

18 Claims, 7 Drawing Sheets

CATCH BASIN SEALING SYSTEM

BACKGROUND OF THE INVENTION

1. Field of the Invention

The present invention relates to catch basin gates and more particularly pertains to a new catch basin gate for closing a basin opening in a catch basin to inhibit contaminants from entering the catch basin.

2. Description of the Prior Art

The use of catch basin gates is known in the prior art. The prior art commonly teaches a gate pivotally mounted in a catch basin which can easily be overcome by water pressure on the gate. While these devices fulfill their respective, particular objectives and requirements, the need remains for a system that has certain improved features the uses a closing plate that is slid into place to close off a basin open and is resistant to being forced open by water pressure. Additionally, the system should include a sensor assembly that detects the vapors released by contaminants and triggers the closing plate to be closed to inhibit further contamination of the catch basin.

SUMMARY OF THE INVENTION

The present invention meets the needs presented above by generally comprising a plurality of guide channels. Each of the guide channels is coupled to a bottom surface of a catch basin. The guide channels are positioned on opposing sides of a basin opening. A closing plate slidably engages the guide channels. The closing plate is slid from a first position adjacent the basin opening to a second position under the basin opening to close the basin opening and inhibit flow of liquid into the catch basin. A seal is coupled to an upper surface of the closing plate. The seal engages the catch basin around the basin opening to inhibit liquid flowing between the closing plate and the catch basin when the closing plate is positioned in the second position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
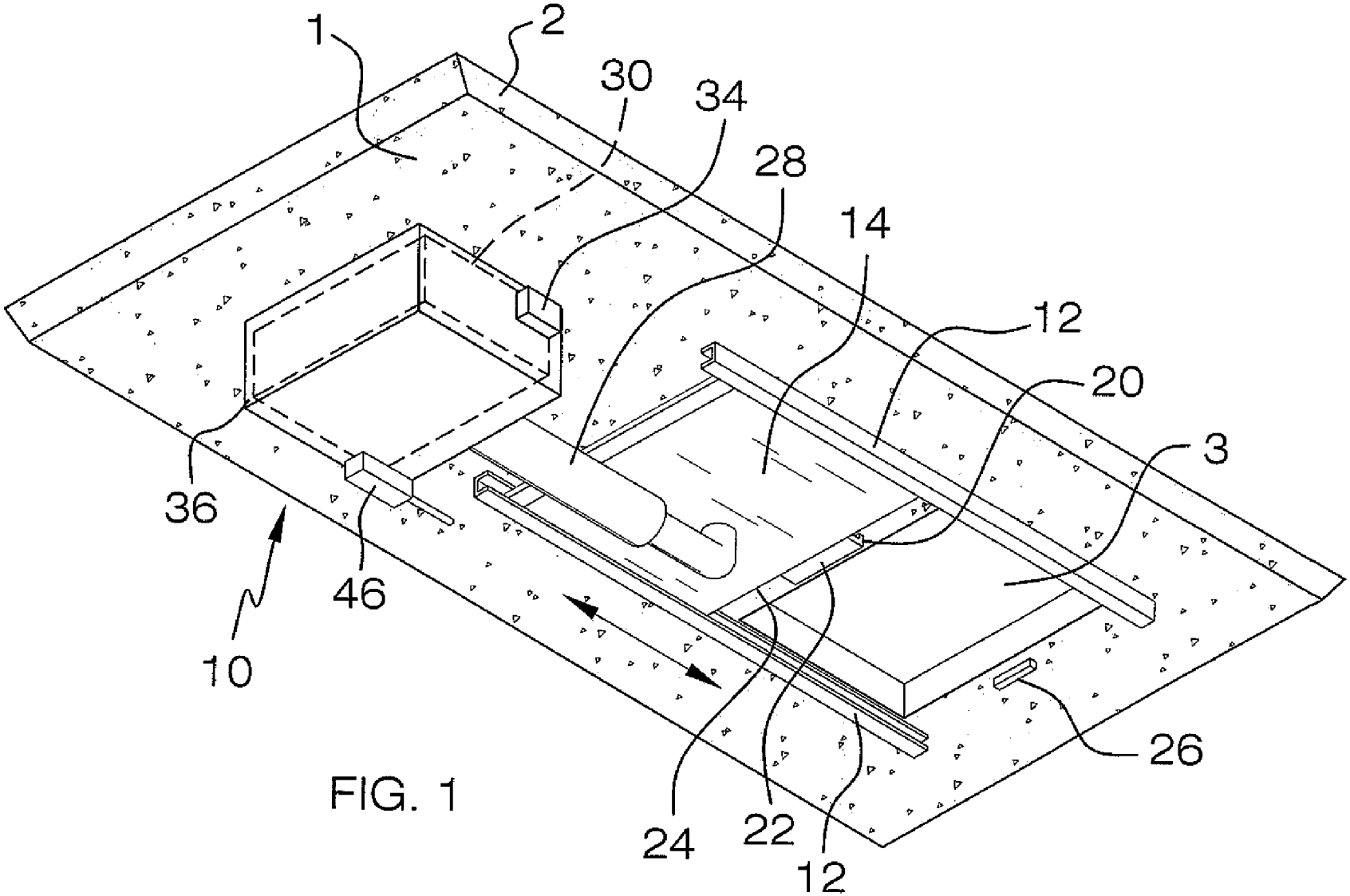
FIG. 1 is a bottom perspective view of a catch basin sealing system according to the present invention.
Figure 2:
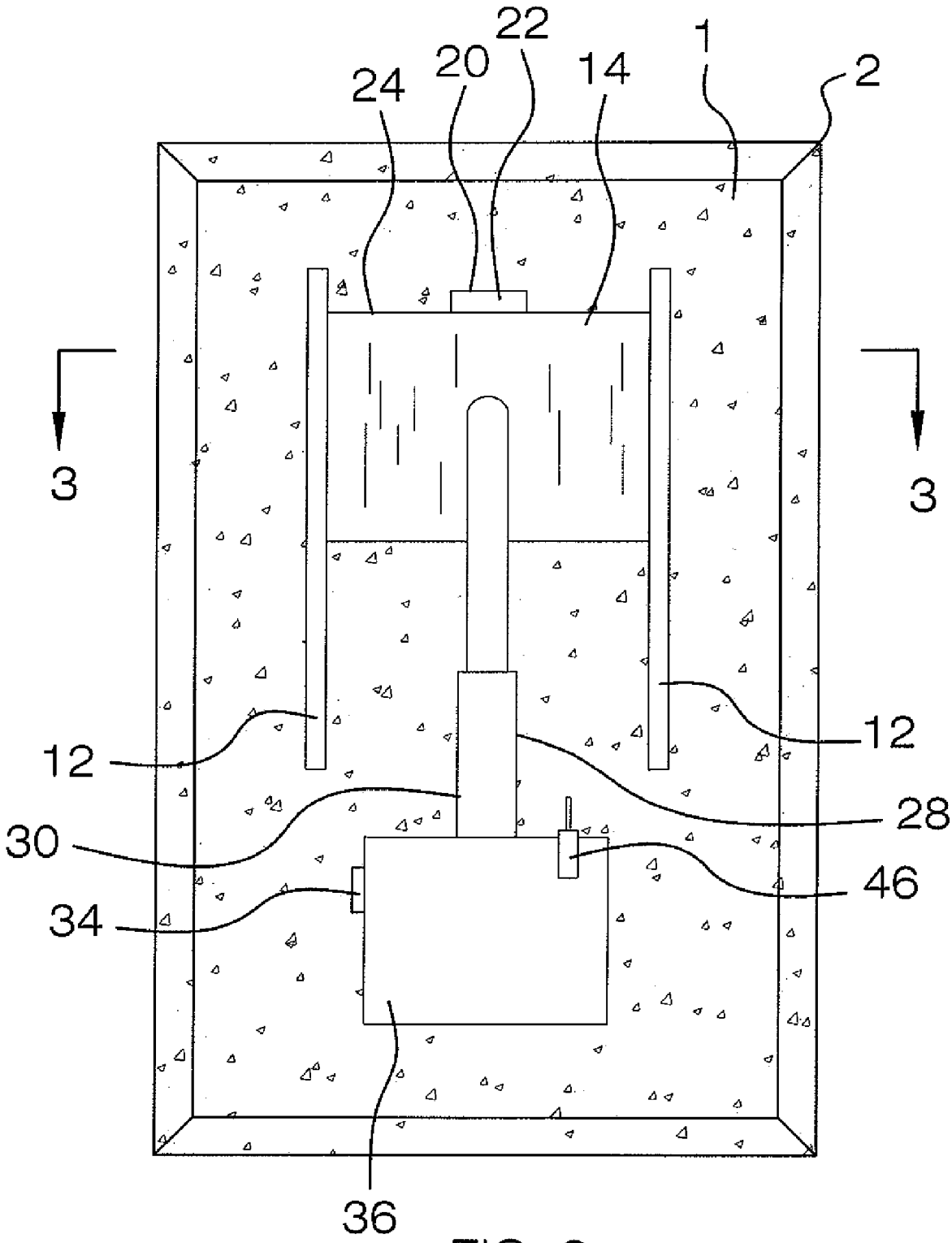
FIG. 2 is a bottom view of the present invention.
Figure 3:
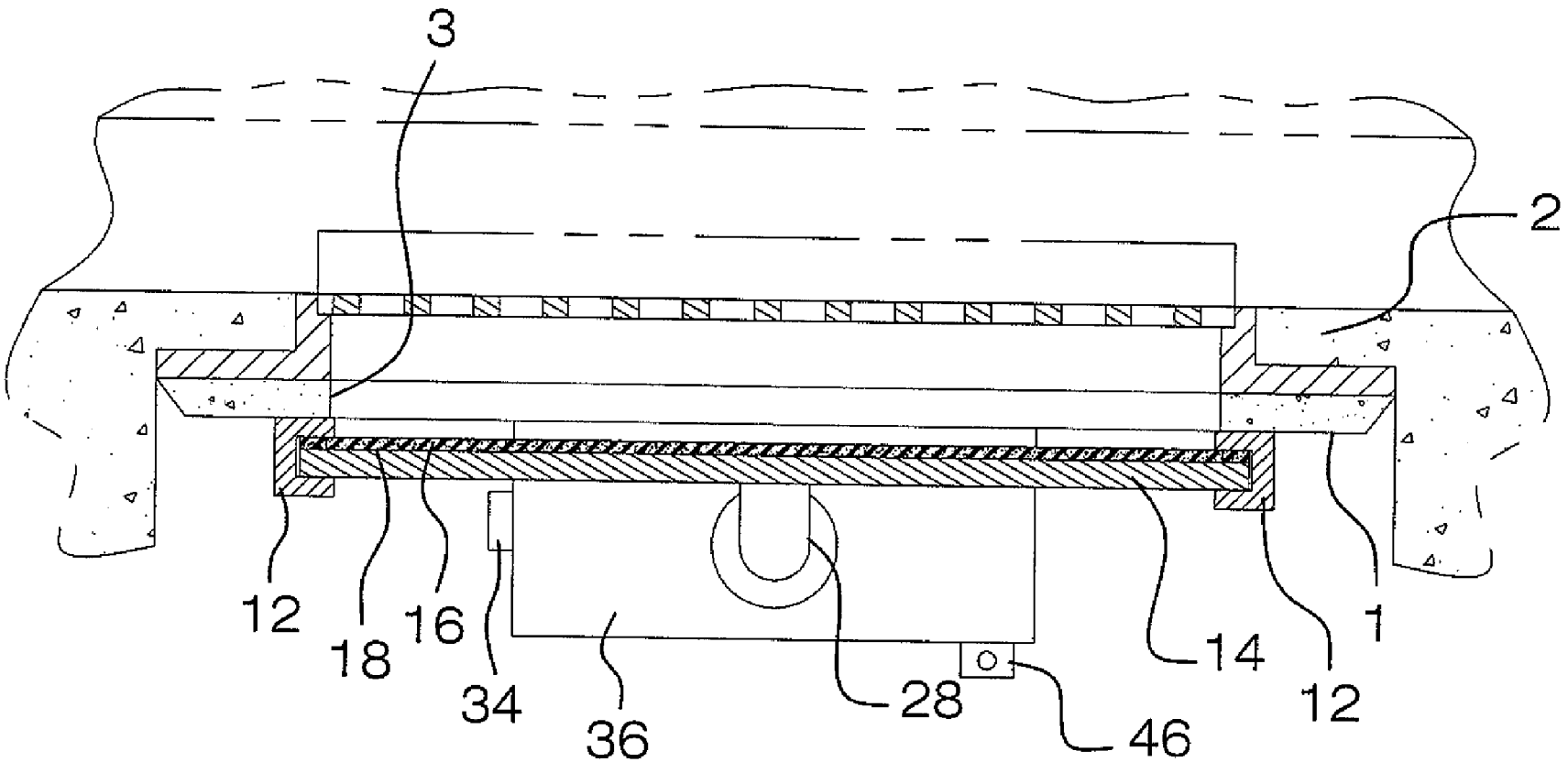
FIG. 3 is a cross-sectional view of the present invention taken along line 3-3 of FIG. 2.
Figure 4:
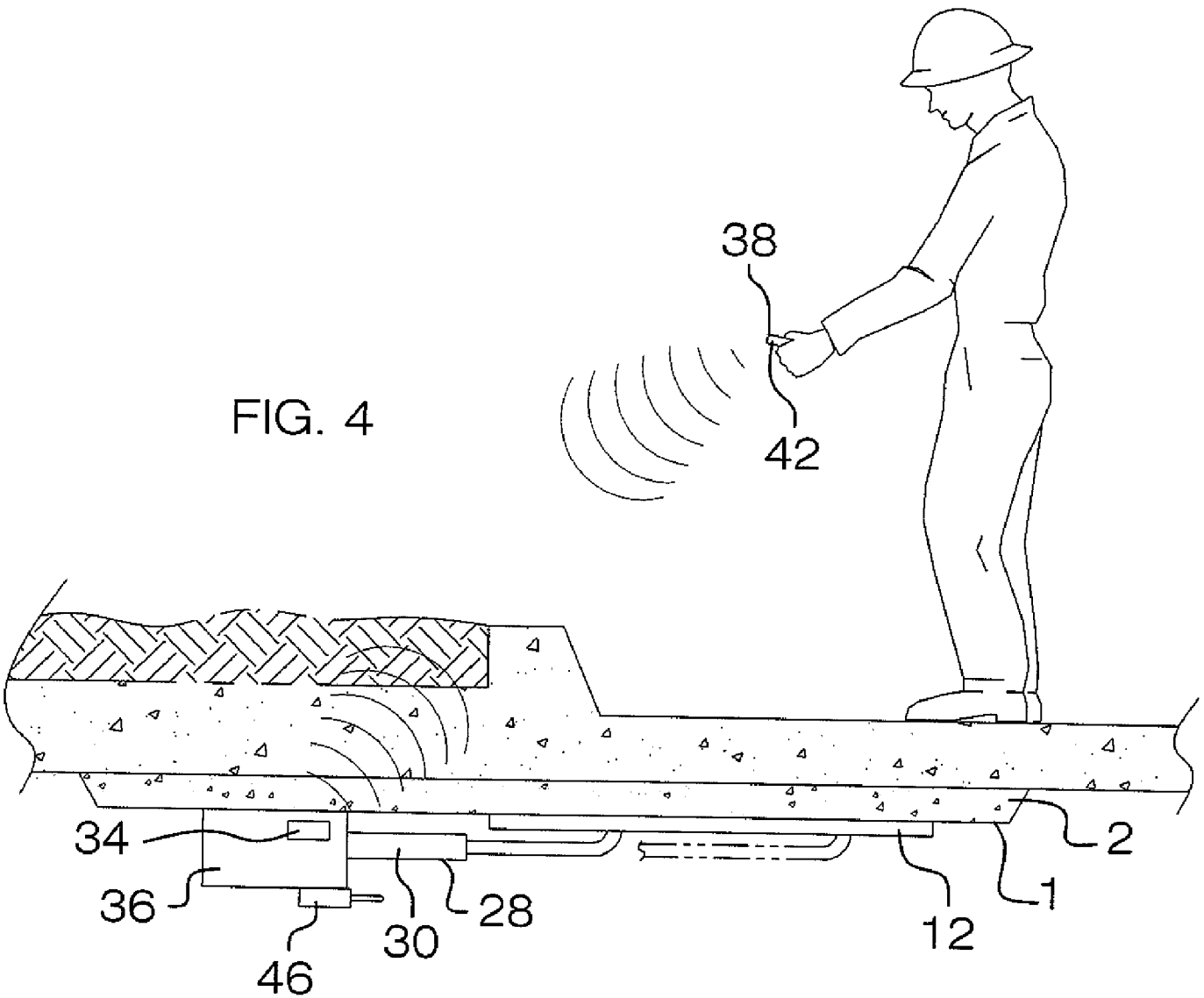
FIG. 4 is a side view of the present invention shown in use.
Figure 5:
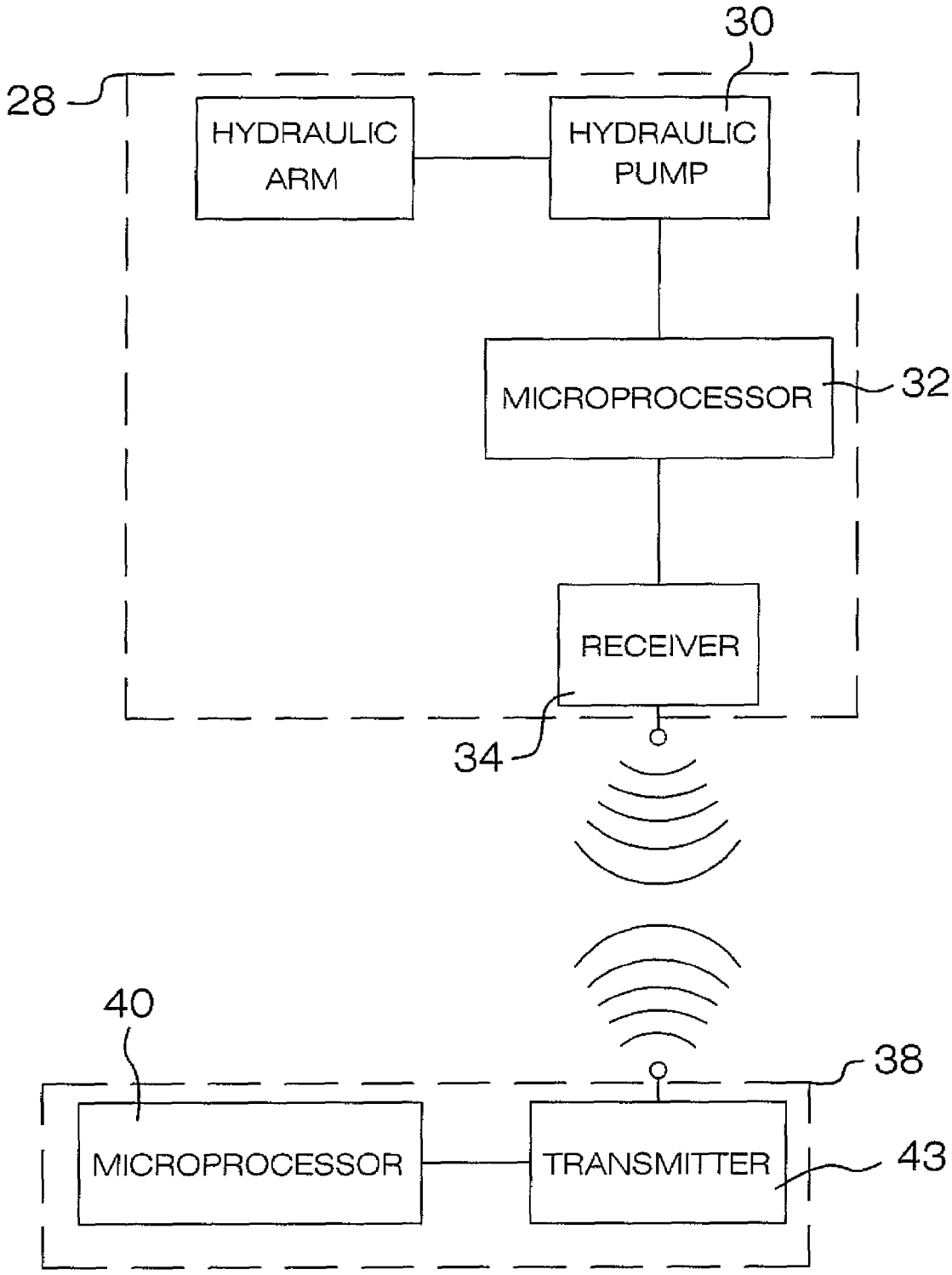
FIG. 5 is a schematic view of the triggering assembly and the actuation assembly of the present invention.

With reference now to the drawings, and in particular to FIGS. 1 through 7 thereof, a new catch basin gate embodying the principles and concepts of the present invention and generally designated by the reference numeral 10 will be described.

As best illustrated in FIGS. 1 through 7, the catch basin sealing system 10 generally comprises a plurality of guide channels 12. Each of the guide channels 12 is coupled to a bottom surface 1 of a catch basin 2. The guide channels 12 are positioned on opposing sides of a basin opening 3. A closing plate 14 slidably engages the guide channels 12. The closing plate 14 is slid from a first position adjacent the basin opening 3 to a second position under the basin opening 3 to close the basin opening 3 and inhibit flow of liquid into the catch basin 2. The closing plate 14 is comprised of a non-flammable material. A seal 16 is coupled to an upper surface 18 of the closing plate 14. The seal 16 engages the catch basin 2 around the basin opening 3 to inhibit liquid flowing between the closing plate 14 and the catch basin 2 when the closing plate 14 is positioned in the second position. The seal 16 is comprised of a resiliently flexible and non-flammable material.

A securing assembly 20 releasably secures the closing plate 14 in the second position. The securing assembly 20 includes at least one locking lip 22 coupled to and extending outwardly from a leading edge 24 of the closing plate 14. The at least one locking lip 22 is approximately L-shaped. At least one locking block 26 is coupled to the bottom surface 1 of the catch basin 2 and positioned adjacent the basin opening 3. The at least one locking lip 22 is extendable over the at least one locking block 26 to snappily engage the at least one locking lip 22 to the at least one locking block 26. The at least one locking lip 22 and the at least one locking block 26 secure the closing plate 14 under the basin opening 3 when the closing plate 14 is slid into the second position and the at least one locking lip 22 engages the at least one locking block 26.

An actuation assembly 28 is coupled to the bottom surface 1 of the catch basin 2. The actuation assembly 28 is mechanically coupled to the closing plate 14. The actuation assembly 28 slides the closing plate 14 between the first position and the second position when the actuation assembly 28 is actuated. The actuation assembly 28 includes a drive system 30 coupled to the bottom surface 1 of the catch basin 2. The drive system 30 is coupled to the closing plate 14. The drive system 30 slides the closing plate 14 between the first position and the second position when the actuation assembly 28 is actuated. A drive microprocessor 32 is in electrical communication with the drive system 30. A drive receiver 34 is in electrical communication with the drive system 30. The drive receiver 34 receives actuation signals remotely transmitted to actuate the drive system 30.

The drive system 30 may comprise a motor that is connected to the closing plate 14 with a chain drive or a worm gear to move the closing plate 14. Additionally, as shown in FIGS. 1 through 4 and 7, the drive system 30 may comprise a hydraulic pump that is connected to a hydraulic arm connected to the closing plate 14 to move the closing plate 14. A cover 36 is coupled to the bottom surface 1 of the catch basin 2 and extends around the drive system 30 of the actuation assembly 28. The cover 36 inhibits contact between the portion of the drive system 30, specifically the motor or the hydraulic pump, and the liquid in the catch basin 2.

A triggering assembly 38 is remotely positioned from the actuation assembly 28. The triggering assembly 38 is configured to selectively actuate the actuation assembly 28 and slide the closing plate 14 between the first position and the second position. The triggering assembly 38 includes a remote microprocessor 40 positioned in a housing 42 of the triggering assembly 38. A remote transmitter 43 is electrically coupled to the remote microprocessor 40. The remote transmitter 43 transmits the actuation signals when the triggering assembly 38 is actuated.

Figure 6:
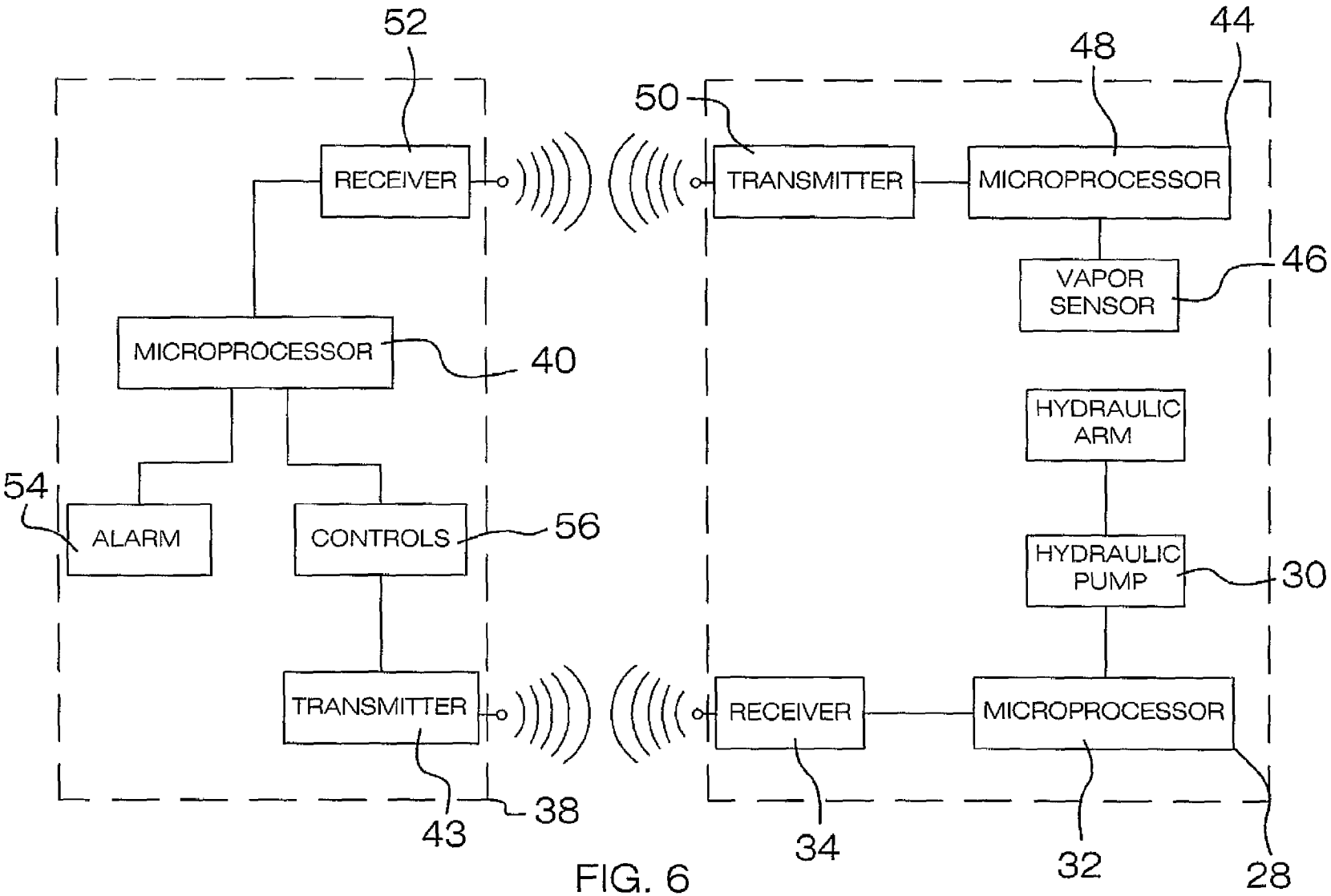
FIG. 6 is a schematic view of the triggering assembly and the actuation assembly of the present invention.
Figure 7:
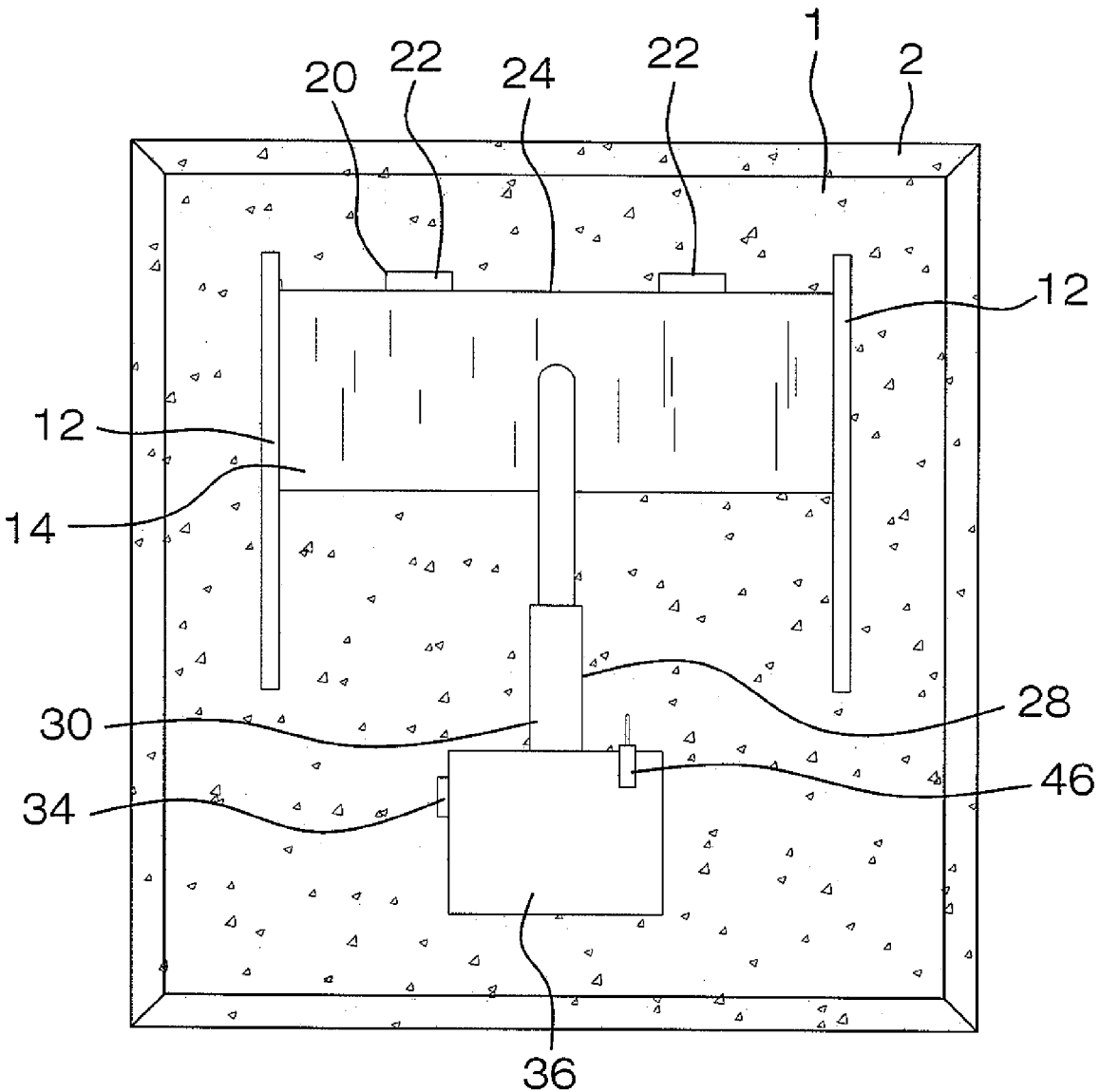
FIG. 7 is a bottom view of an embodiment of the present invention.

In an embodiment, as shown in FIG. 6, a sensor assembly 44 is positioned adjacent the actuation assembly 28. The sensor assembly 44 senses vapors from the contaminants in the catch basin 2 and sends alert signals to the triggering assembly 38 to actuate the actuation assembly 28. The sensor assembly 44 includes a vapor sensor 46 configured to detect vapors from contaminants in the catch basin 2. A sensor microprocessor 48 is in electrical communication with the vapor sensor 46 and receives signals from the vapor sensor 46. The sensor microprocessor 48 sends an alarm signal when the vapor sensor 46 detects contaminants. A sensor transmitter 50 is in electrical communication with the sensor microprocessor 48. The sensor transmitter 50 receives the alarm signal from the sensor microprocessor 48 and transmits the alarm signal.

Additionally, the triggering assembly 38 of the embodiment shown in FIG. 6 also includes an alarm receiver 52 in electrical communication with the remote microprocessor 40. The alarm receiver 52 receives the alarm signals from the sensor transmitter 50 and conveys the alarm signals to the remote microprocessor 40. The remote microprocessor 40 sends the actuating signals to the remote transmitter 43 when the remote microprocessor 40 receives the alarm signals. An alarm system 54 is in electrical communication with the remote microprocessor 40. The alarm system 54 is actuated to alert a person to the presence of the contaminants in the catch basin 2 when the remote microprocessor 40 receives the alarm signals. A control system 56 is in electrical communication with the remote microprocessor 40 and the remote transmitter 43. The control system 56 is actuated to manually send the actuation signals to the remote transmitter 43 when the control system 56 is manually actuated.

In use, the guide channels 12, the closing plate 14 and the drive assembly are mounted to the bottom surface 1 of the catch basin 2. A person carrying the triggering assembly 38 actuates the triggering assembly 38 to actuate the actuation assembly 28 to slide the closing plate 14 under the basin opening 3. The closing plate 14 and the seal 16 inhibit any of the liquid contaminates that may flow into the basin opening 3 from entering the catch basin 2 and possibly being distributed to a water source.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In a catch basin, the improvement comprising:

a catch basin sealing system to inhibit contaminates from entering a catch basin and to minimize contamination of a water source, said system comprising:

a plurality of guide channels, each of said guide channels being coupled to a bottom surface of the catch basin, said guide channels being positioned on opposing sides of a basin opening;

a closing plate slidably engaging said guide channels, said closing plate being slid from a first position adjacent the basin opening to a second position under the basin opening to close said basin opening and inhibit flow of liquid into the catch basin; and a seal being coupled to an upper surface of said closing plate, said seal engaging the catch basin around the basin opening to inhibit liquid flowing between said closing plate and the catch basin when said closing plate is positioned in said second position.

2. The system according to claim 1, wherein said closing plate is comprised of a non-flammable material.

3. The system according to claim 1, wherein said seal is comprised of a resiliently flexible and non-flammable material.

4. The system according to claim 1, further comprising a securing assembly releasably securing said closing plate in said second position.

5. The system according to claim 1, further comprising an actuation assembly being coupled to the bottom surface of the catch basin, said actuation assembly being mechanically coupled to said closing plate, said actuation assembly sliding said closing plate between said first position and said second position when said actuation assembly is actuated.

6. The system according to claim 5, further comprising a triggering assembly being remotely positioned from said actuation assembly, said triggering assembly being configured to selectively actuate said actuation assembly and slide said closing plate between said first position and said second position.

7. The system according to claim 6, wherein said triggering assembly includes a remote microprocessor being positioned in a housing of said triggering assembly.

8. The system according to claim 7, wherein said triggering assembly includes a remote transmitter being electrically coupled to said remote microprocessor, said remote transmitter transmitting the actuation signals when said triggering assembly is actuated.

9. The system according to claim 6, further comprising a sensor assembly being positioned adjacent said actuation assembly, said sensor assembly sensing vapors from the contaminants in the catch basin and sending alert signals to said triggering assembly to actuate said actuation assembly.

10. The system according to claim 9, wherein said sensor assembly includes a vapor sensor being configured to sense vapors from contaminants in the catch basin.

11. The system according to claim 10, wherein said sensor assembly includes a sensor microprocessor being in electrical communication with said vapor sensor and receiving signals from said vapor sensor, said sensor microprocessor sending an alarm signal when said vapor sensor detects contaminants.

12. The system according to claim 11, wherein said sensor assembly includes a sensor transmitter being in electrical communication with said sensor microprocessor, said sensor transmitter receiving the alarm signal from the sensor microprocessor and transmitting the alarm signal.

13. The system according to claim 12, wherein said triggering assembly includes an alarm receiver being in electrical communication with said triggering assembly, said alarm receiver receiving the alarm signals from said sensor transmitter and conveying the alarm signals to said triggering assembly and actuate said actuation assembly.

14. The system according to claim 1, wherein said actuation assembly includes a drive system being coupled to the bottom surface of the catch basin, said drive system being coupled to said closing plate, said drive system sliding said closing plate between said first position and said second position when said actuation assembly is actuated.

15. The system according to claim 14, further comprising a cover being coupled to the bottom surface of the catch basin and extending around said drive system of said actuation assembly, said cover inhibiting contact between the portion of said drive system and liquid in the catch basin.

16. The system according to claim 14, wherein said actuation assembly includes a drive microprocessor being in electrical communication with said drive system.

17. The system according to claim 16, wherein said actuation assembly includes a drive receiver being in electrical communication with said drive system, said drive receiver receiving actuation signals remotely transmitted to actuate said drive system.

18. A catch basin sealing system to inhibit contaminates from entering a catch basin and to minimize contamination of a water source, said system comprising:

a plurality of guide channels, each of said guide channels being coupled to a bottom surface of the catch basin, said guide channels being positioned on opposing sides of a basin opening;

a closing plate slidably engaging said guide channels, said closing plate being slid from a first position adjacent the basin opening to a second position under the basin opening to close said basin opening and inhibit flow of liquid into the catch basin, said closing plate being comprised of a non-flammable material;

a seal being coupled to an upper surface of said closing plate, said seal engaging the catch basin around the basin opening to inhibit liquid flowing between said closing plate and the catch basin when said closing plate is positioned in said second position, said seal being comprised of a resiliently flexible and non-flammable material;

a securing assembly releasably securing said closing plate in said second position, said securing assembly comprising;

at least one locking lip being coupled to and extending outwardly from a leading edge of said closing plate, said at least one locking lip being approximately L-shaped;

at least one locking block being coupled to the bottom surface of the catch basin and positioned adjacent the basin opening, said at least one locking lip being extendable over said at least one locking block to secure said closing plate under the basin opening when said closing plate is slid into said second position;

an actuation assembly being coupled to the bottom surface of the catch basin, said actuation assembly being mechanically coupled to said closing plate, said actuation assembly sliding said closing plate between said first position and said second position when said actuation assembly is actuated, said actuation assembly comprising;

a drive system being coupled to the bottom surface of the catch basin, said drive system being coupled to said closing plate, said drive system sliding said closing plate between said first position and said second position when said actuation assembly is actuated;

a drive microprocessor being in electrical communication with said drive system;

a drive receiver being in electrical communication with said drive system, said drive receiver receiving actuation signals remotely transmitted to actuate said drive system;

a cover being coupled to the bottom surface of the catch basin and extending around said drive system of said actuation assembly, said cover inhibiting contact between the portion of said drive system and liquid in the catch basin;

a triggering assembly being remotely positioned from said actuation assembly, said triggering assembly being configured to selectively actuate said actuation assembly and slide said closing plate between said first position and said second position, said triggering assembly comprising;

a remote microprocessor being positioned in a housing of said triggering assembly; and a remote transmitter being electrically coupled to said remote microprocessor, said remote transmitter transmitting the actuation signals when said triggering assembly is actuated.

* * * * *